US006273282B1

(12) United States Patent
Ogg et al.

(10) Patent No.: US 6,273,282 B1
(45) Date of Patent: Aug. 14, 2001

(54) GRIPPABLE CONTAINER

(75) Inventors: Richard K. Ogg, Littlestown; Sheldon E. Yourist, York; Michael R. Mooney, Wrightsville, all of PA (US); Paul Kelley, Thurmont, MD (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/539,359

(22) Filed: Mar. 31, 2000

Related U.S. Application Data

(63) Continuation-in-part of application No. 09/093,655, filed on Jun. 12, 1998, now Pat. No. 6,044,997.

(51) Int. Cl.[7] ..... B65D 90/02

(52) U.S. Cl. ..... 215/381; 215/379; 215/382; 215/389

(58) Field of Search ..... D9/370, 392, 396, D9/530, 552, 553, 554, 538; 215/370, 379, 381, 382, 383, 384

(56) References Cited

U.S. PATENT DOCUMENTS

| | | | | |
|---|---|---|---|---|
| D. 208,732 | * | 9/1967 | Benes | 215/538 |
| D. 294,118 | * | 2/1988 | Papa | D9/390 |
| D. 320,154 | | 9/1991 | Alberghini et al. . | |
| D. 340,190 | | 10/1993 | Skidmore et al. . | |
| D. 344,457 | | 2/1994 | Prevot et al. . | |
| D. 346,556 | * | 5/1994 | Sirio et al. | D9/538 |
| D. 365,277 | | 12/1995 | Hencher . | |
| D. 366,416 | | 1/1996 | Semersky . | |
| D. 366,417 | | 1/1996 | Semersky . | |
| D. 366,831 | | 2/1996 | Semersky et al. . | |
| D. 374,826 | | 10/1996 | Mackinson et al. . | |
| D. 378,274 | | 3/1997 | Beaver . | |
| D. 378,353 | | 3/1997 | Emre et al. . | |
| D. 387,279 | | 12/1997 | Emre et al. . | |
| D. 390,471 | * | 2/1998 | Ito | D9/539 |
| D. 398,538 | | 9/1998 | Fuquen et al. . | |
| D. 398,539 | | 9/1998 | Guislain . | |
| D. 412,845 | * | 8/1999 | Miller et al. | D9/434 |
| D. 420,588 | * | 2/2000 | Fitelson | D9/434 |
| D. 420,919 | | 2/2000 | Ogg . | |
| 2,013,243 | | 9/1935 | Landon . | |
| 3,536,500 | | 10/1970 | Cleereman . | |
| 3,923,178 | * | 12/1975 | Welker, III | 215/379 |
| 4,023,679 | | 5/1977 | Hammes . | |
| 4,700,856 | | 10/1987 | Campbell et al. . | |
| 4,813,556 | | 3/1989 | Lawrence . | |
| 5,178,289 | | 1/1993 | Krishnakumar et al. . | |
| 5,224,614 | | 7/1993 | Bono et al. . | |
| 5,238,129 | | 8/1993 | Ota . | |
| 5,392,937 | | 2/1995 | Prevot et al. . | |
| 5,598,941 | | 2/1997 | Semersky et al. . | |
| 5,740,934 | * | 4/1998 | Brady | 215/381 |
| 5,762,221 | | 6/1998 | Tobias et al. . | |
| 5,803,290 | | 9/1998 | Bongiorno . | |
| 6,044,996 | * | 4/2000 | Carew et al. | 215/381 |
| 6,044,997 | | 4/2000 | Ogg . | |
| 6,095,360 | * | 8/2000 | Shmagin et al. | 215/382 |

* cited by examiner

*Primary Examiner*—Allan N. Shoap
*Assistant Examiner*—Tri M. Mai
(74) *Attorney, Agent, or Firm*—Howson and Howson

(57) ABSTRACT

An ergonomically friendly container having hot-fill capabilities is disclosed. The container has a dome with grip surfaces that undergo controlled deformation for accommodating a portion of the volumetric shrinkage due to hot filling, capping and cooling. Preferably, a major portion of each grip surface is circumscribed by a brow rib which prevents unwanted dome distortion while permitting an amount of controlled vacuum absorption. In addition, the container body is provided with vacuum flex panels of at least two different sizes which enable the grip surfaces to be located close to the center of gravity of a filled container to provide balanced pouring of the contents from the container.

16 Claims, 4 Drawing Sheets

GRIPPABLE CONTAINER

RELATED APPLICATION

This application is a continuation-in-part of U.S. application Ser. No. 09/093,655, filed Jun. 12, 1998 now U.S. Pat. No. 6,044,997.

FILED OF THE INVENTION

The present invention relates to grippable blow-molded plastic containers, and more particularly, the present invention relates to hot-fillable blow-molded plastic containers having grip features that facilitate lifting and pouring.

BACKGROUND OF THE INVENTION

The conventional hot-fillable blow-molded PET container is generally characterized by a body portion having a series of identical, vertically-elongate vacuum flex panels disposed in spaced relation about its periphery for accommodating volumetric shrinkage in the container due to the vacuum created after the container has been hot-filled with liquid, capped and cooled to ambient temperature. The upper portion, or dome, of the container has been generally characterized by a circular cross-section having a waist. Some people use the waist to grip the container for pouring with one hand, but this is not satisfactory because the waist is too large to be gripped readily. A stepped dome is easier to grip, but does not facilitate pouring from the container because it is too far from the filled container center of gravity.

At present, it has been necessary to make the vacuum flex panels relatively long in order to accommodate the amount of vacuum induced shrinkage required to provide a commercially satisfactory container. Examples of such containers are disclosed in the following U.S. patents owned by the assignee of the present application: D366,416; D366,417; D366,831.

Efforts have been made to incorporate grips in hot-fillable containers to afford both ease of pouring and to accommodate the vacuum induced shrinkage of the container. An example of such a container manufactured by the assignee of the present application is disclosed in the following U.S. Pat. Nos. D344,457; 5,392,937; and 5,598,941.

The aforementioned containers have certain advantages and certain disadvantages. The conventional vacuum panel has the advantage of enabling relatively large size containers with large labelable areas to be produced; however, it has a disadvantage of making such containers difficult to handle. Grip panel containers, on the other hand, have the advantage of providing relatively easy pourability for certain sizes; however, grip panels are difficult to provide in large size containers, and labelable areas are reduced. It is apparent, therefore, that there is a need for a blow-molded plastic container that provides both the ready gripability and pourability afforded by grip-panel containers while providing large labelable areas and avoiding the limitations associated with conventional vacuum-panel containers.

OBJECTS OF THE INVENTION

With the foregoing in mind, a primary object of the present invention is to provide a novel grippable container that provides facile gripping and pouring of its contents.

Another object of the present invention is to provide an improved hot-fillable blow-molded container which utilizes a novel configuration of vacuum panels.

Still another object of the present invention is to provide an improved hot-fillable blow-molded container which utilizes a novel configuration of vacuum panels in combination with a specially configured grip dome that cooperates with the vacuum panels to accommodate the requisite vacuum induced shrinkage of the container due to hot-filling, capping and cooling.

Yet another object of the present invention is to provide a container having grips formed in its dome to facilitate gripping and pouring of contents from the container while utilizing at least one relatively short vacuum panel to thereby provide the container with an ergonomically-improved lifting and pouring balance.

A still further object of the present invention is to provide a plastic blow-molded container having a reinforced grip dome which resists distortion from forces caused by hot-fill processing.

SUMMARY OF THE INVENTION

More specifically, the present invention provides a blow-molded grippable container having a body portion with a series of vacuum panels and a dome portion which incorporates grip panels to facilitate gripping and pouring of contents from the container. The grip surfaces are adapted to be engaged between a finger and thumb of the user, and the dome is configured to enable the opposed grip surfaces to flex toward one another to accommodate a predetermined amount of volumetric shrinkage due to hot-filling, capping and cooling. A major portion of each grip surface is circumscribed by a brow rib which prevents unwanted dome distortion while permitting a required degree of vacuum absorption. The vacuum flex panels provided in the body portion below the dome accommodate another predetermined amount of volumetric shrinkage. The vacuum flex panels are provided in at least two different sizes to permit the grip surfaces to be located close to the center of gravity of the filled container.

BRIEF DESCRIPTION OF THE DRAWINGS

The foregoing and other objects, features and advantages of the present invention should become apparent from the following description when taken in conjunction with the accompanied drawings, in which.

DESCRIPTION OF THE PREFERRED EMBODIMENTS

Figure 1:
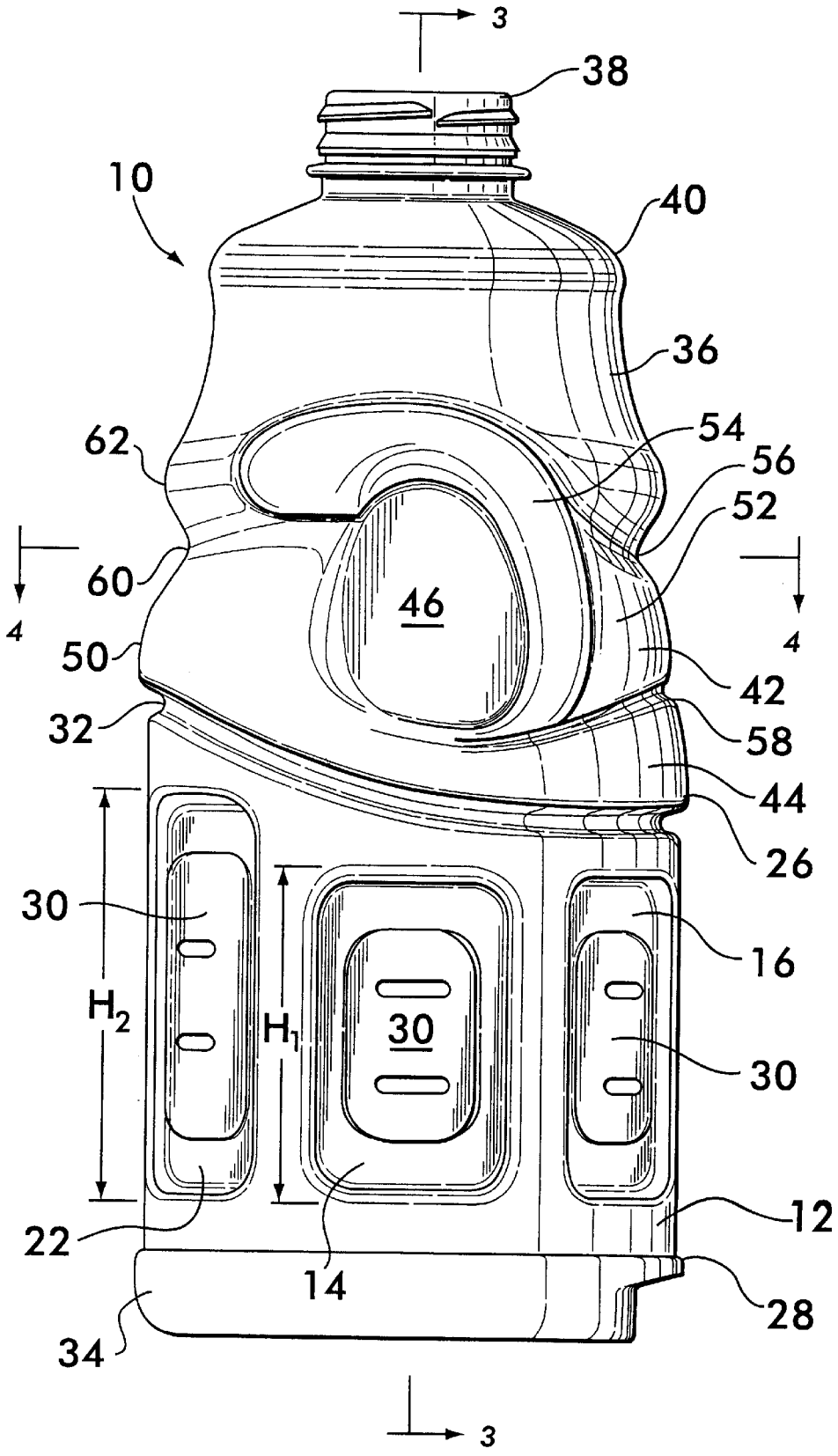
FIG. 1 is a side elevational view of a grippable container embodying the present invention.

Referring now to the drawings, FIG. 1 illustrates a grippable container 10 which is particularly suited for hot fill applications. As best seen therein, the container 10 has a body portion 12, which may be of tubular cross section, such as cylindrical or rectangular. The body portion 12 of the container 10 has an upper label bumper 26, a lower label bumper 28, and six circumferentially spaced vacuum panels, such as the panels 14, 16, 18, 20 and 22 (one vacuum panel which is identical to panel 22 not being shown in the drawings). The vacuum panels are located between the label bumpers 26 and 28 and accommodate vacuum induced shrinkage resulting from liquid contraction due to the hot fill process. Thus, the term vacuum induced volumetric shrinkage as used herein refers to such shrinkage, and not to inherent thermally-induced volumetric shrinkage. Each vacuum panel has a customary label support region 30 for supporting a label (not shown) in the region between the upper and lower label bumpers 26 and 28.

A suitable base 34 is provided below the lower label bumper 28. The base 34 is of conventional construction having appropriate reinforcing ribs, such as radial ribs, to provide the desired stiffness and anti-everting capabilities preferred for a hot fill container, as well known in the art.

The novel configuration of the vacuum panels on the body portion 12 of container 10 includes vacuum panels of at least two different sizes. For example, as illustrated, vacuum panels 14, 16, 18 and 20 are identical and have a height "$H_1$". The vacuum panel 22 and the adjacent unillustrated vacuum panel are identical and have a height "$H_2$". In the illustrated embodiment, as best illustrated in FIG. 1, the height "$H_1$" is equal to about 80% of the height "$H_2$". Of course other vacuum panel size relationships could be utilized in accordance to the present invention.

The upper label bumper 26 is contoured in relation to the height of the vacuum panels. To this end, the upper label bumper 26 does not extend entirely in a horizontal plane; rather, its elevation relative to the base 34 increases above vacuum panel 22 and decreases where it extends above vacuum panels 14, 16, 18 and 20. An inwardly extending peripheral stiffening rib 32 is located adjacent and below the upper label bumper 26 and reinforces the hoop-strength of the container 10. The rib 32 follows the same contour as the upper label bumper 26.

The container 10 has a dome portion 36 superposed on the body portion 12. The dome portion 36 has a conventional flanged upstanding finish 38 with threads (not shown) adapted to receive a cap. The dome portion 36 has an upper section 40, an intermediate section 42, and a lower section 44 adjacent the upper label bumper 26.

Figure 4:
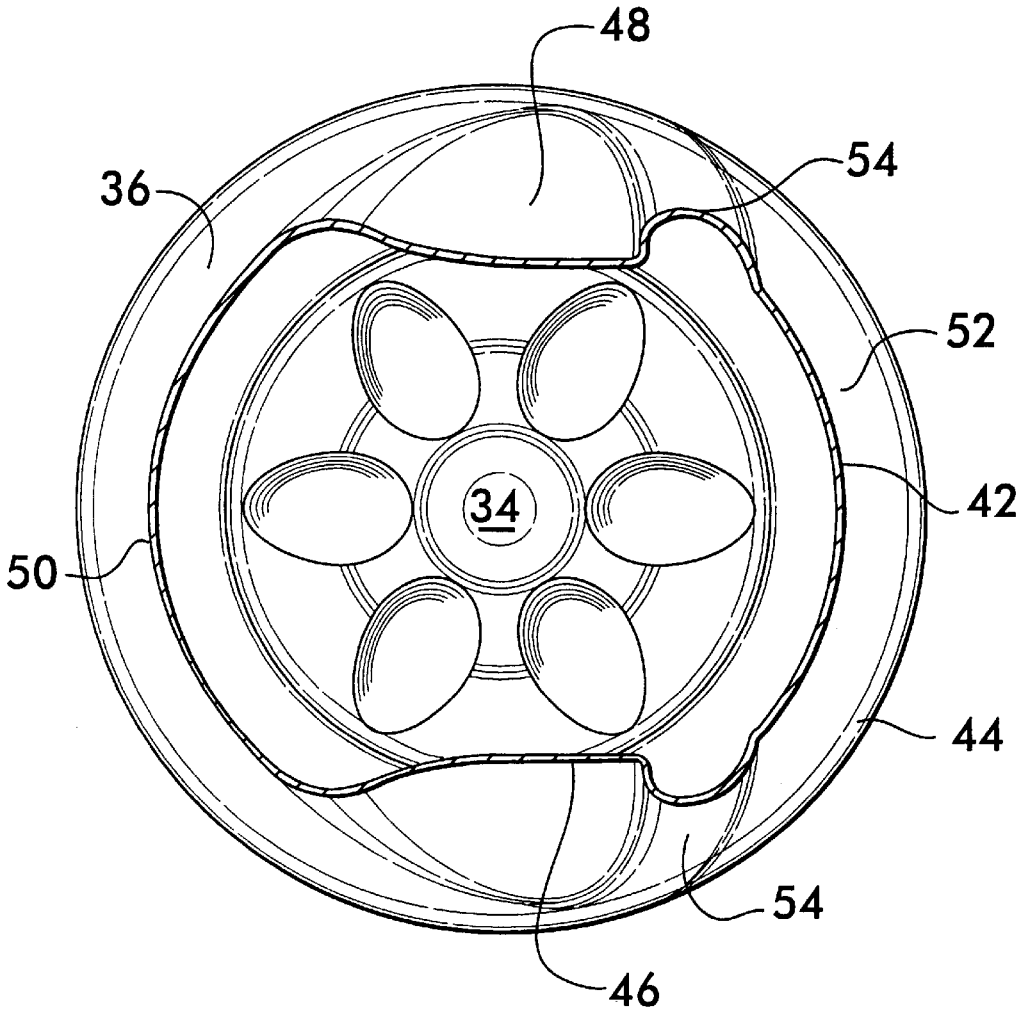
FIG. 4 is a transverse sectional view taken along line 4—4 of FIG. 1.

The upper dome section 40 is substantially circular in horizontal crosssection and extends outwardly and downwardly from the finish 38. However, as best illustrated in FIG. 4, the intermediate dome section 42 has a non-circular horizontal cross-section The lower dome section 44 has a substantially circular horizontal cross-section that flares outwardly and downwardly to merge with the upper label bumper 26.

Figure 2:
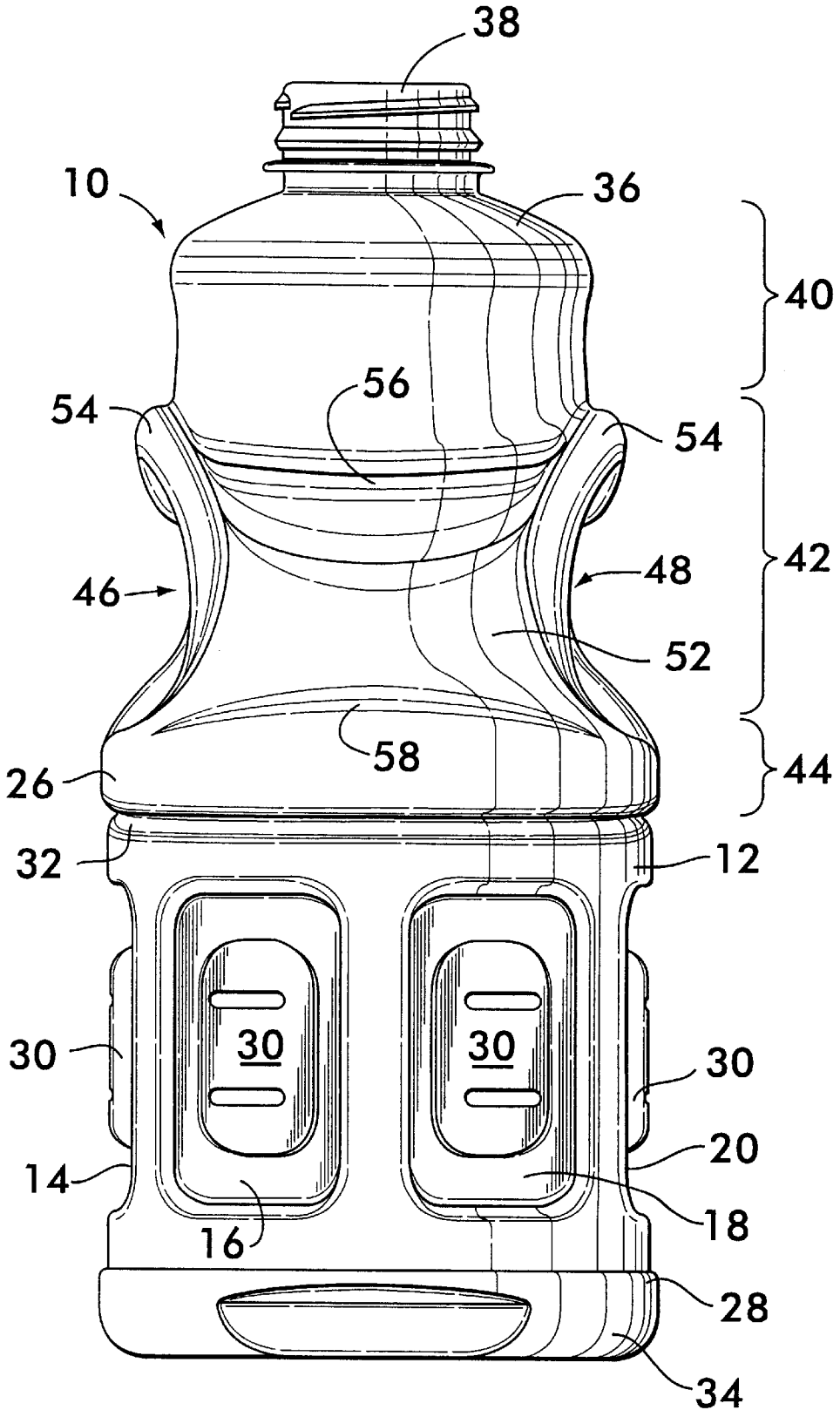
FIG. 2 is a rear elevational view of the container illustrated in FIG. 1.
Figure 3:
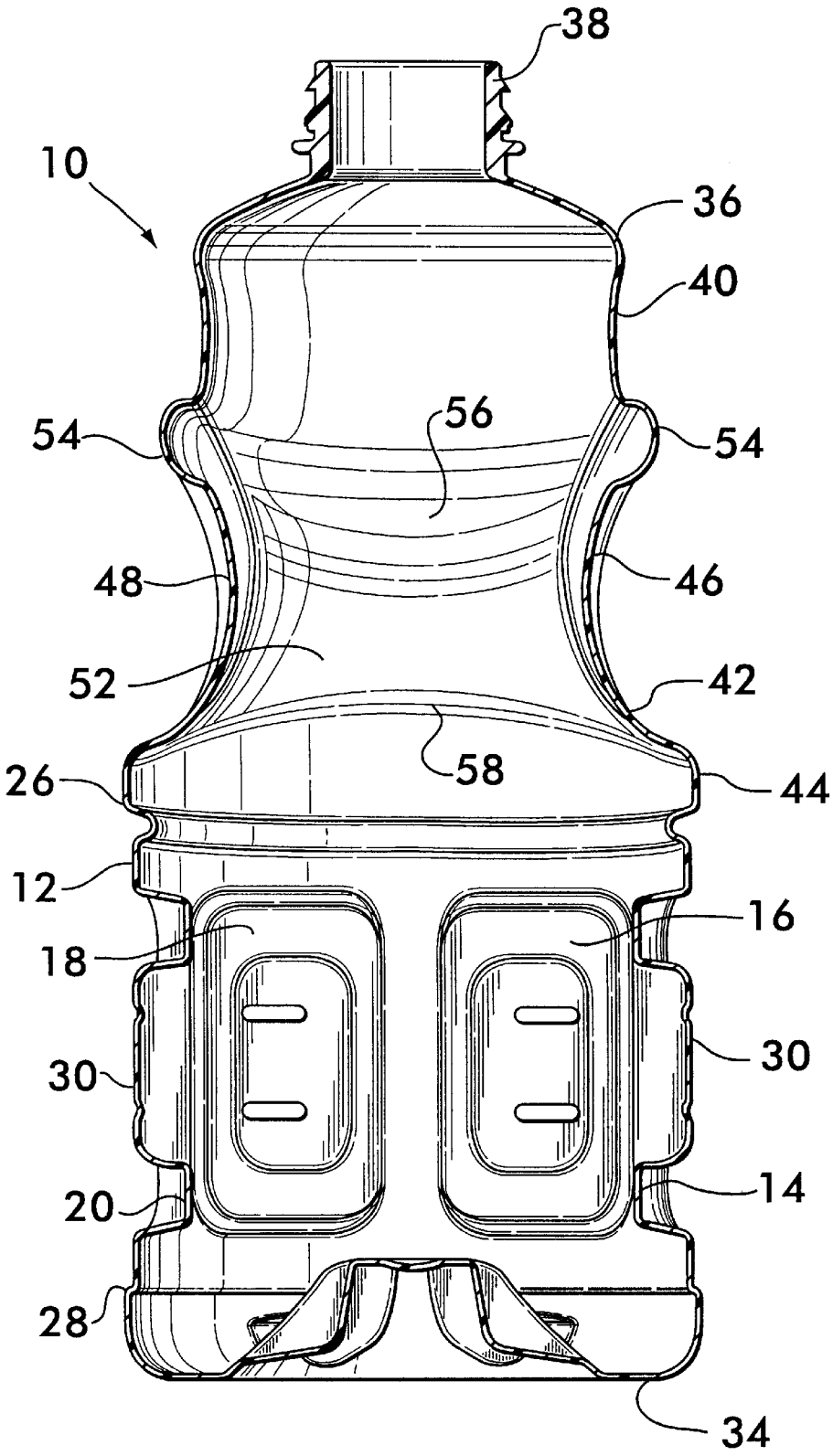
FIG. 3 is a transverse sectional view taken along line 3—3 of FIG. 1.

The intermediate dome section 42 has a pair of opposed grip surfaces 46 and 48 which permit ready gripping of the container 10. As best illustrated in FIG. 2, each grip surface 46 and 48 is inset into the dome portion 36 and is preferably outwardly concave to afford engagement between a user's thumb and fingers. The grip surfaces 46 and 48 extend equidistantly on opposite sides of the container longitudinal axis A—A and are located above the upper label bumper 26. The front and rear intermediate dome section surfaces, 50 and 52, respectively, interconnect the opposite side ends of the grip surfaces 46 and 48 and are less deeply inset into the dome 36 than the grip surfaces 46 and 48. As illustrated in the drawings, the front surface 50 is located above the tall vacuum panel 22 and its adjacent identical panel (not shown).

A major portion of each grip surface, 46 and 48, is circumscribed by a brow rib 54 which structurally reinforces the grip surfaces and prevents unwanted distortion of the dome. As best illustrated in FIG. 4, each brow rib 54 projects outwardly from the container and is convex in horizontal cross-section. Preferably, as best illustrated in FIG. 1, the brow ribs 54 extend continuously at least above the grip surfaces 46 and 48 and along the side ends of the grip surfaces 46 and 48 adjacent the rear surface 52 of the intermediate dome section 42. Preferably, the brow ribs 54 do not extend entirely around the side ends of the grip surfaces 46 and 48 adjacent the front surface 50 of the intermediate dome section 42 so that a user's thumb and fingers have unrestricted access into the grip surfaces 46 and 48. Thus, the brow ribs 54 not only reinforce the structure of the container 10, but also help to direct the proper placement of the hand of the user across the front surface 50 of the intermediate dome section 42.

The container dome portion 36 can have other reinforcement structures to prevent unwanted distortion of the container 10. For example, as illustrated in the drawings, inwardly-extending, horizontally-disposed ribs 56 and 58 reinforce the rear surface 52 and inwardly extending rib 60 reinforces the front surface 50 of the intermediate dome section 42. The ledge 62 above the indentation of the rib 60 provides a support for the user's hand and prevents slippage between the user's hand and the container 10.

Another important aspect of the present invention is that its dimensional and surface configurations cooperate to provide a container which can be lifted and its contents poured in a facile manner. To this end, by way of example and not by way of limitation, the container 10 can be provided, for instance, with a filled nominal capacity of 96 ozs. The capacity of the body portion 12 up to the upper label bumper 26, is about 45 to 60 ounces, and the capacity of the dome between the upper label bumper 26 and the top of the finish 38 is about 36 to 51 ounces. As a result, the dome portion provides approximately 37 to 53% of the total nominal volumetric capacity of the container 10. By way of comparison with a stock 96 oz circular bell cross-section conventional vacuum panel container of Applicant's manufacture, the bell volume constitutes about 30% of the total container filled volume.

Preferably, the filled center of gravity of the container is located in a range of about 40% to about 45% of the overall container height, or length, and the grip surfaces 46 and 48 are located upwardly adjacent the filled center of gravity within about 55% to about 65%, and more preferably about 60% of the overall container height. The relatively centered location of the grip panels, 46 and 48, is permitted due to the relatively short height of the vacuum panels 14, 16, 18 and 20. This location for grasping the location affords balanced pouring from the container 10.

Another important aspect of the present invention is that the container 10 is particularly suited for hot-fill applications. Under conditions of hot-filling with liquid at a temperature approaching 200° F., capping, and cooling to ambient temperatures of about 72° F., the body portion vacuum panels, 14–22, flex inwardly to accommodate volumetric shrinkage. However, unlike conventional hot fill containers, the vacuum panels in the body portion 12 do not accommodate all of the container's volumetric shrinkage. Rather, in the container 10 of the present invention, the dome portion 36, in particular the grip panels 46 and 48, accommodate approximately 5% of the total volumetric shrinkage of the container 10 due to hot fill, capping, and cooling. The balance is accommodated by the vacuum panels in the body portion 12.

The grip surfaces 46 and 48 are mounted to flex inwardly toward one another to accommodate volumetric shrinkage in the dome portion 36. The geometry of the dome tends to afford flexure primarily from side to side to provide the requisite grip surface movement. The brow and reinforcement ribs 54, 56, 58 and 60 prevent unwanted distortion while permitting a required amount of vacuum absorption.

As a result of dome vacuum absorption, the vacuum panels 14, 16, 18 and 20 in the body portion 12 are shorter in vertical height than conventional flex panels, since they do not provide the sole means for vacuum absorption. By reducing the height of some of the vacuum panels, and providing a predetermined measure of vacuum absorption in the dome portion 36, the grip surfaces 46 and 48 are able to be located at a point slightly higher than the filled center of gravity of the container 10 which makes the container 10 easy to grasp, lift, and pour, as contrasted with conventional cylindrical vacuum flex panel containers which simply have circular dome cross-sectional configurations with concomitant ergonomic limitations. In addition, despite the different sizes of the vacuum panels utilized in the body portion 12 of the container 10, the novel structure of the container 10 permits the container to remain symmetrical even after volumetric shrinkage.

The dome configurations 36 not only provide ergonomically-desirable lift and pour capabilities, but also provide excellent top loading capabilities. The shortened height of some of the flex panels reduces the height of the label toward the rear of the container, but still provides a label area larger in size than on a comparable sidewall grip container. The larger dome enables customer designs and logotypes to be molded prominently in the dome.

Preferably, the container 10 is blow molded of PET plastic in a heat-set mold utilizing commercially available blow-molding equipment.

If the hot fill capabilities are not required, the body portion vacuum panels may be eliminated, and other plastic materials may be used. The container 10 would still retain their ergonomic lift and pour capabilities.

The dome portion 36 can be provided with alternate configurations different from that of the illustrated embodiment. For example, the shape of the grip panels 46 and 48 can be altered; the brow rib 54 can extend about more or less of the grip panels and could be formed by multiple discontinuous sections; the other reinforcement ribs 56, 58 and 60 could be provided in other shapes; and the peripheral stiffening rib 32 could be provided by a plurality of discontinuous sections.

While a preferred embodiment of the present invention has been described in detail, various modifications, alterations and changes may be made without departing from the spirit and scope of the invention as defined in the appended claims.

What is claimed is:

1. A grippable container comprising:

a body portion having a plurality of peripherally spaced vacuum flex panels for accommodating vacuum-induced volumetric shrinkage resulting from hot filling, capping and cooling of the container when filled with liquid, said plurality of vacuum flex panels being provided in at least two different sizes including relatively tall vacuum flex panels and relatively short vacuum flex panels, and a dome portion with a finish above said body portion, said dome portion having an opposed pair of grip surfaces affording engagement between a user's thumb and finger, and an upper label bumper extending peripherally around the container below said grip surfaces and above said vacuum flex panels, said upper label bumper extending upwardly over said relatively tall vacuum flex panels and downwardly over said relatively short vacuum flex panels, whereby the grip surfaces afford facile lifting and pouring of contents from the container.

2. A container according to claim 1 wherein each of said grip surfaces is at least partially circumscribed by a brow rib which prevents unwanted distortion of said dome portion.

3. A container according to claim 2, wherein a major portion of each of said grip surfaces is circumscribed by one of said brow ribs.

4. A container according to claim 3, wherein said grip surfaces are inset into said dome portion and said brow ribs project outwardly from said dome portion.

5. A container according to claim 4, wherein said grip surfaces are outwardly concave and said brow ribs are outwardly convex.

6. A container according to claim 5, wherein at least said grip surfaces being moveable inwardly toward one another to accommodate vacuum-induced volumetric shrinkage resulting from hot filling, capping and cooling of the container when filled with liquid.

7. A container according to claim 6 wherein said dome portion accommodates about 5% of the total vacuum-induced shrinkage of the container after hot-filling, capping and cooling to ambient conditions.

8. A container according to claim 1, wherein said plurality of vacuum flex panels includes at least two adjacent relatively tall vacuum flex panels and at least four adjacent relatively short vacuum flex panels.

9. A container comprising:

a body portion having a plurality of peripherally spaced vacuum flex panels for accommodating vacuum-induced volumetric shrinkage resulting from hot filling, capping and cooling of the container when filled with liquid;

a dome portion with a finish extending above said body portion, said plurality of vacuum flex panels being provided in at least two different sizes including at least one relatively tall vacuum flex panel and at least one relatively short vacuum flex panel; and a contoured upper label bumper extending peripherally around the container above said vacuum flex panels, said upper label bumper extending upwardly over said relatively tall vacuum flex panels and downwardly over said relatively short vacuum flex panels.

10. A container according to claim 9, wherein plurality of vacuum flex panels includes at least two adjacent relatively tall vacuum flex panels and at least four adjacent relatively short vacuum flex panels.

11. A container according to claim 9, wherein said dome portion has an opposed pair of grip surfaces affording engagement between a user's thumb and finger to afford facile lifting and pouring of contents from the container.

12. A container according to claim 11, wherein each of said grip surfaces is at least partially circumscribed by a brow rib which prevents unwanted distortion of said dome portion.

13. A readily grippable, hot-fillable, container having facile handling characteristics, comprising:

a cylindrical body portion having a circumferentially-extending single file row of a plurality of peripherally spaced vacuum flex panels of at least two different sizes including at least one relatively tall vacuum flex panel and at least one relatively short vacuum flex panel, said body portion having a contoured upper label bumper with said vacuum flex panels located therebelow, a dome portion with an upstanding finish overlying said body portion, said dome portion having a pair of opposed grip surface formed therein to afford engagement by a user's thumb and finger when the user's hand is engaged transversely with the dome portion, said dome portion above said contoured upper label bumper being flexible to enable at least said grip surfaces to move inwardly toward one another for accommodating vacuum-induced shrinkage resulting from hot filling, capping and cooling of the container, whereby at least some of the vacuum-induced volumetric shrinkage of the container is accommodated by the dome while the grip surfaces afford facile lifting and pouring of the container contents by the user.

14. A container according to claim 13, wherein each of said grip surfaces is at least partially circumscribed by a brow rib which prevents unwanted distortion of said dome portion.

15. A container according to claim 14, wherein a major portion of each of said grip surfaces is circumscribed by one of said brow ribs.

16. A readily grippable, hot-fillable, container according to claim 13, wherein at least one of said vacuum flex panels has an outwardly-extending island formed thereon.

* * * * *